United States Patent [19]

Nowobilski et al.

[11] Patent Number: 4,561,498

[45] Date of Patent: Dec. 31, 1985

[54] INTERCOOLER WITH THREE-SECTION BAFFLE

[75] Inventors: Jeffert J. Nowobilski, Orchard Park; Arun Acharya, East Amherst, both of N.Y.

[73] Assignee: Union Carbide Corporation, Danbury, Conn.

[21] Appl. No.: 591,858

[22] Filed: Mar. 21, 1984

[51] Int. Cl.[4] ..... F28F 9/22

[52] U.S. Cl. ..... 165/160; 165/161; 62/93

[58] Field of Search ..... 165/159, 157, 160, 161; 62/93

[56] References Cited

U.S. PATENT DOCUMENTS

| | | | |
|---|---|---|---|
| 2,997,280 | 8/1961 | Keast | 165/157 |
| 3,074,480 | 1/1963 | Brown et al. | 165/160 |
| 3,532,160 | 10/1970 | Garrison | 165/159 |
| 4,415,024 | 11/1983 | Baker | 165/160 |

FOREIGN PATENT DOCUMENTS

| | | | |
|---|---|---|---|
| 151614 | 7/1950 | Australia | 165/159 |
| 2111387 | 9/1972 | Fed. Rep. of Germany | 165/160 |
| 196095 | 12/1982 | Japan | 165/160 |
| 382780 | 12/1964 | Switzerland | 165/160 |
| 398656 | 3/1966 | Switzerland | 165/159 |
| 396266 | 3/1932 | United Kingdom | 165/159 |
| 2039021 | 7/1980 | United Kingdom | 165/160 |
| 958831 | 9/1982 | U.S.S.R. | 165/160 |

*Primary Examiner*—William R. Cline
*Assistant Examiner*—Richard R. Cole
*Attorney, Agent, or Firm*—Stanley Ktorides

[57] ABSTRACT

A heat exchanger for use with a pressurized fluid having a three-section sealing baffle between the inlet and outlet which improves efficiency by causing the fluid to flow more evenly and reducing the tendency of the fluid to recirculate or flow in eddies.

18 Claims, 7 Drawing Figures

INTERCOOLER WITH THREE-SECTION BAFFLE

TECHNICAL FIELD

This invention relates generally to the field of heat exchange and in particular to heat exchangers for cooling a pressurized stream without significant degradation of the pressure.

BACKGROUND ART

It is often desired to carry out a heat exchange operation with a stream at pressure without significantly degrading the pressure of the stream. One such example is the rejection of the heat of compression from a stream of compressed air which is intended as feed for an air separation plant. Another example is the rejection of the heat of compression from compressed natural gas which has been compressed to pipeline pressure. When the heat exchanger to accomplish this task is placed between stages of a multistage compressor it is often termed an intercooler.

Effective heat exchange is carried out by efficient contact between hot and cold media. One way to achieve such efficient contact is to arrange even distribution of the flowing media with respect to each other. This is especially the case for an intercooler where only one pass can be made due to the pressure loss considerations. Pressure loss may be caused by flow disturbances, areas of flow recirculation, drag of the core, and changes in area. A successful intercooler must provide good heat transfer while keeping pressure loss to a low level.

The above-described considerations have been addressed by the prior art. U.S. Pat. No. 3,532,160—Garrison describes an intercooler with a baffle to separate the inlet and outlet ports and a perforated plate which acts as a gas distribution means. The baffle is at a right angle to the intercooler length. The perforated plate achieves good gas distribution but imparts a relatively high pressure drop to the compressed stream.

U.S. Pat. No. 4,415,024—Baker discloses an improvement to the Garrison system wherein the separating baffle is diagonally oriented with respect to the intercooler length. This diagonal baffle has the dual purpose of separating the inlet and outlet ports and distributing the compressed gas flow. However, the separating plate taught by Baker allows some of the inlet gas to flow away from the intended direction of the tube bundle because the area behind the inlet port is open. Similarly, on the outlet side, flow may recirculate in a non-useful manner due to the configuration of the baffle. This non-useful flow causes an unnecessary loss of pressure energy.

It is therefore an object of this invention to provide an improved heat exchanger for use with a stream at elevated pressure.

It is a further object of this invention to provide an improved heat exchanger having relatively even flow distribution while not imparting an excessive pressure drop on the compressed gas stream.

SUMMARY OF THE INVENTION

The above and other objects which will become apparent to one skilled in the art upon a reading of this disclosure are attained by the present invention which comprises:

An apparatus for heat transfer with a stream at elevated pressure comprising:

(a) a longitudinal shell;

(b) end plates on each end of said longitudinal shell to form an enclosure;

(c) inlet and outlet ports spaced axially along said longitudinal shell;

(d) a baffle plate within said enclosure oriented diagonally with respect to said longitudinal shell between said inlet and outlet ports; and (e) baffle plate end sections connected respectively to each end of said baffle plate, extending respectively from the vicinity of said inlet and outlet ports to said end plates, and oriented at an angle in the range of equal to or greater than 0 degrees with respect to said longitudinal shell and opposite in sign from the angle of the diagonal baffle.

As used herein, the term "approach temperature" means the difference between the cooling stream inlet temperature and the gas stream outlet temperature.

DETAILED DESCRIPTION

The heat exchanger of this invention will be described in detail with reference to the drawings.

Figure 1:
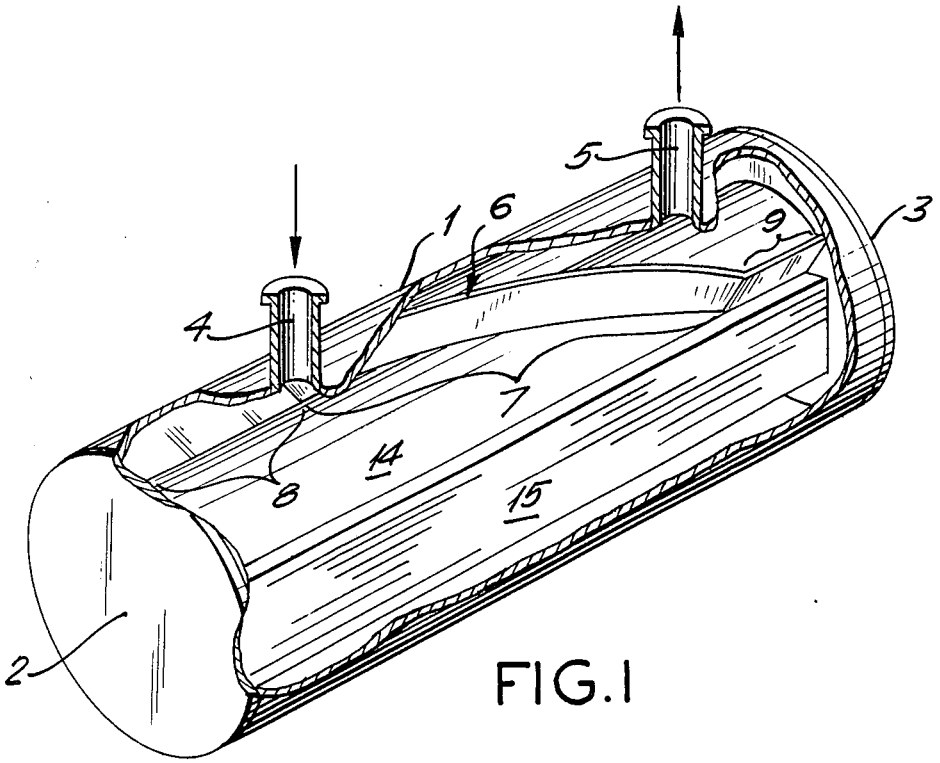
FIG. 1 is a cutaway perspective view of one embodiment of the heat exchanger apparatus of this invention.

Future 1 depicts an intercooler of this invention which may be used between stages of a multistage compressor to cool the compressed gas. Referring now to FIG. 1, the intercooler is comprised of longitudinal shell 1 having end plates 2 and 3 on each end to form an enclosure. The longitudinal shell is typically a right cylinder but it may have any effective longitudinal shape. Inlet port 4 and outlet port 5 are spaced axially along the longitudinal shell and provide means by which warm pressurized fluid, generally gas, may flow into and out of the enclosure. Cooling is provided in the FIG. 1 intercooler by tube bundle 15 comprised of a plurality of tubes through which flows a cooling medium such as water. The tube bundle has a top bundle cover sheet 14 interposed between the tube bundle and the longitudinal shell.

Separating or sealing baffle 6 is within the enclosure and is composed of three parts: middle diagonal section 7 and end sections 8 and 9. The middle section is oriented diagonally with respect to the longitudinal shell and is located between inlet port 4 and outlet port 5 so as to separate incoming from outgoing fluid to prevent short circuiting of the heat exchanger. The end sections connect to the diagonal baffle plate at each end and extend from the inlet and outlet ports to the end sections. The end sections are each at an angle in the range of equal to or greater than 0 degrees with respect to the longitudinal sheel and opposite in sign from the angle of the diagonal baffle plate. In FIG. 1 the end sections 8 and 9 are each in line with the longitudinal shell, i.e., they are at a 0° angle. Although the end sections are described as being connected to the middle section this is not meant to imply that they are necessarily separate pieces. The three section baffle could be a unitary piece.

Preferably the baffle extends from the cover sheet 14 through the entire radial distance to the longitudinal shell. Connection to or contact with the cover sheet and the shell may be by any means such as welding or by the use of suitable sealing material. In this way sealing between the inlet and outlet flows is enhanced. This configuration also allows utilization of the maximum available flow area for the gas, so gas velocity is decreased and pressure loss in this area is minimized.

In operation warm compressed gas enters the intercooler through inlet port 4 and expands into the space bordered by shell 1, baffle 6, cover sheet 14, and end plates 2 and 3. Baffle 6 separates inlet 4 from outlet 5 and directs the flow along the length of shell 1. The compressed gas then flows across tube bundle 15 and is cooled by flow around the tubes of tube bundle 15. After crossing tube bundle 15, the cooled compressed gas is directed by baffle 6 towards outlet port 5 and out of the intercooler. The three-part sealing baffle ensures that the compressed gas receives wide exposure to the heat exchange means, which in this case is tube bundle 15, while ensuring a short path through the intercooler with minimal recirculatory patterns thus imparting very little pressure loss to the compressed gas as it passes through the intercooler.

The three-part sealing baffle of the heat exchanger of this invention will be described in greater detail with reference to FIGS. 2–6. The numbering in FIGS. 2–6 is the same as in FIG. 1 for the common elements.

Figure 2:
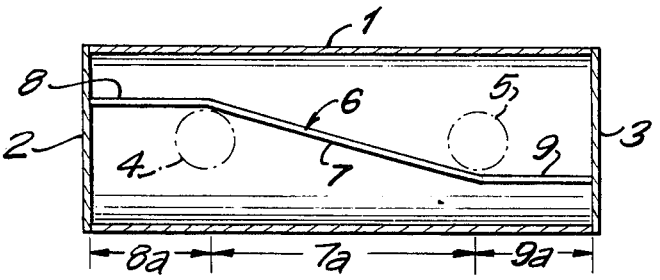
FIGS. 2–6 are cross-sectional plan views of various embodiments of the heat exchanger apparatus of this invention which illustrate various configurations of applicants' three-section separating baffle.

Referring now to FIG. 2, sealing baffle 6 is composed of middle diagonal section 7 and end sections 8 and 9 which extend respectively to end plates 2 and 3. End section 8 prevents inlet gas from flowing away from the direction of the tube bundle while end section 9 prevents cooled gas from flowing past outlet port 5 before it exits the intercooler. That is, the end sections substantially prevent flow recirculation.

The middle section 7 is oriented between the inlet and outlet ports at an angle diagonal to longitudinal shell 1. The angle is preferably as small as possible consistent with having the baffle between two ports. In other words it is preferred that diagonal baffle 7 pass as close as is practical to the back, i.e., non-flow direction, of the inlet and outlet ports. Preferably the angle is from 5° to 45°, most preferably from 10° to 30° with respect to the longitudinal shell. In the vicinity of each port, each end section connects to an end of the middle section and extends to the end plate. The angle of the end sections with respect to the longitudinal shell is in the range of equal to or greater than 0 degrees and opposite in sign from the angle of the diagonal middle section or diagonal baffle plate. That is, looking at FIG. 2 from right to left, end section 8 is bent back with respect to middle section 7, and looking at FIG. 2 from left to right, end section 9 is bent back with respect to middle section 7. The angle of the end sections may be 0° as in FIG. 2 or may be a negative angle as much as −90°. Preferably the end section angle with respect to the longitudinal shell is from −25° to −90°. Although the two end sections will typically be at the same angle, this is not necessary and they could be at different angles.

The axial length 8*a* of end section 8 and the axial length 9*a* of end section 9 are generally equal, although they need not be, and can be varied to influence flow configuration and intercooler performance. If the positions of the inlet and outlet ports are fixed by a given compressor, the axial length of the end sections can be changed by changing the total length of the intercooler. The axial length of each end section may be from 10 percent to 45 percent of the intercooler length and preferably is from 20 to 30 percent with the remainder occupied by the axial length 7*a* of the diagonal baffle 7.

If the combined axial lengths of the end sections is relatively large and the inlet and outlet ports are both relatively near the middle of the intercooler, it would be more difficult to evenly distribute the flow since the pressurized fluid would prefer the short, direct path through the middle part of the tube bundle rather than the long path from the middle to either end and back. A long intercooler does have the advantage of greater surface area available from heat exchange although the equipment would be cumbersome and costly. If the combined axial lengths of the end sections is relatively small and the inlet and outlet ports are near the ends of the intercooler, all paths between the inlet and outlet would be substantially the same length and the gas will therefore be well distributed. However, the available heat exchanger area would be small so the gas may not be well cooled. The consequential greater gas velocity results in a larger pressure drop and therefore the overall performance would suffer.

Figure 3:
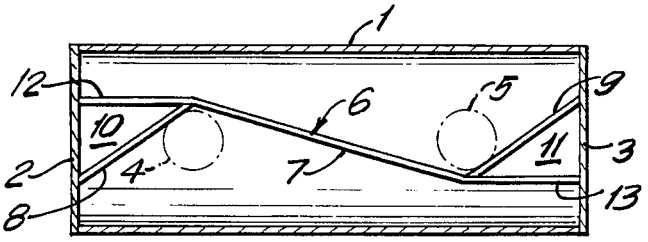

FIG. 3 depicts another embodiment of the three-section baffle of the heat exchanger of this invention wherein the end sections 8 and 9 are at a negative angle with respect to the longitudinal shell. The terms positive and negative angle are used for clarity and simplicity and mean an angle formed respectively by clockwise and counterclockwise rotation with respect to the axis of the longitudinal shell. In FIG. 3 the angles of end sections 8 and 9 are both about 35 degrees in absolute value. In this way end section 8 not only prevents inlet gas from blowing away from the tube bundle but also directs the gas stream towards the tube bundle. Similarly, outlet end section 9 directs flow towards outlet port 5.

FIG. 3 also illustrates a preferred option for use with the heat exchanger of this invention. Deflecting vane 12 extends from the connection of end section 8 and middle section 7 to end plate 2 thus enclosing area 10 and preventing gas on the outlet side of the tube bundle from recirculating into area 10. The deflecting vane can connect either to the middle section or the end section as well as at their meeting point and has an angle arithmetically greater than that of the end section with respect to the longitudinal shell. Similarly deflecting vane 13 prevents inlet flow from forming an eddy by closing off area 11. Thus heat transfer efficiency is aided by the improved directional effect of angled end sections 8 and 9 and also pressure loss is reduced by the reduction in recirculation swirls effected by the presence of deflecting vanes 12 and 13.

Figure 4:
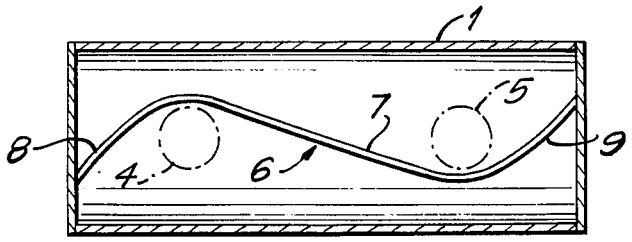
Figure 5:
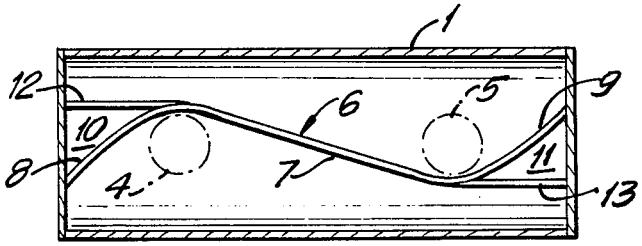

Since sharp corners cause pressure losses, the curved baffle of FIG. 4 may be employed to more closely approach the theoretical minimum pressure loss for the required flow at the inlet and outlet. FIG. 5 illustrates the FIG. 4 embodiment with the deflecting vanes described with reference to FIG. 3. As can be appreciated by one skilled in the art, the curved baffles of FIGS. 4 and 5, although theoretically more efficient, may be more difficult to construct and therefore more costly that non-curved baffles.

Figure 6:
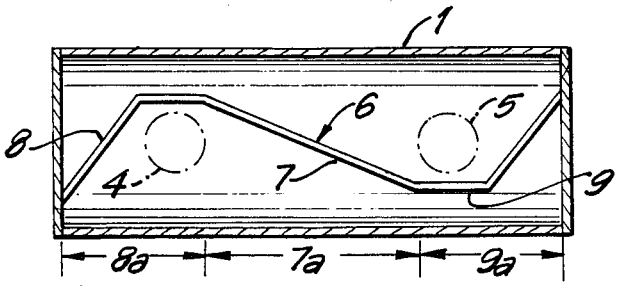

In order to reduce somewhat the cost of a curved baffle, the curved baffle of FIGS. 4 and 5 may be approximated by a series of straight line segments as shown in FIG. 6. Also shown in FIG. 6 are the axial length indicators for the middle section and the two end sections. Deflecting vanes as shown in FIGS. 3 and 5 may also, of course, be used with the embodiment illustrated in FIG. 6.

As can be appreciated with reference to FIGS. 4–6, the angle of the end section need not be fixed and it may vary within the defined range along the axial length of the end section.

Figure 7:
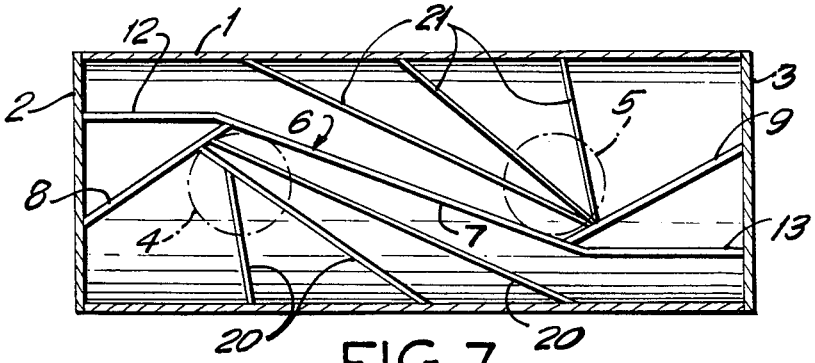
FIG. 7 is a cross-sectional plan view of another embodiment of the heat exchanger of this invention illustrating its use with flow distribution vanes.

FIG. 7 illustrates another embodiment of this invention which furthers even fluid distribution so that a lesser approach temperature and thus better heat transfer performance may be achieved. FIG. 7 illustrates a baffle and deflecting vanes similar to that of FIG. 3 and the numbering system is the same as that of FIG. 3 for the common elements. The FIG. 7 embodiment further comprises distribution vanes 20 at the fluid inlet and collection vanes 21 at the fluid outlet side of the intercooler. The vanes run from the end section or from another distribution or collection vane and extend at least across the top of the tube bundle. The vanes ideally pass through as much of the open space from the inlet or outlet port to the tube bundle as is possible, but this may not be practical from a fabrication standpoint. The vanes should not touch the tube bundle as the bundle expands and moves during operation.

Distribution vanes 20 are positioned to divide the inlet stream into portions of equal mass flow rate. In the FIG. 7 embodiment the distribution vanes are positioned so as to divide the flow area into four sections of approximately equal area. On the outlet side collection vanes 21 direct the flow to approximately equal areas at outlet port 5.

One or more distribution vanes and/or collection vanes may be used. A greater number of vanes will increase the distribution or collection capability of the system. However, the vanes add a small frictional pressure loss and increase the cost of fabrication. It has been found that the embodiment of FIG. 7, with one deflecting vane and three distribution/collection vanes on both inlet and outlet sides gives satisfactory temperature approach without incurring other significant penalties.

The intercooler of this invention was tested and compared to results obtainable by a commercially available intercooler. Two embodiments, corresponding to intercoolers illustrated in FIGS. 2 and 7 were tested and the results obtained are tabulated in Table I under columns A and B respectively. The commercially available intercooler was of the type disclosed in U.S. Pat. No. 3,532,150—Garrison and the results are also shown in Table I under column C. For the intercooler of the FIG. 2 type the axial length of the inlet end section was 42 percent of the shell axial length and the axial length of the outlet end section was 29 percent of the shell axial length. The angle of the diagonal baffle was 24° with respect to the longitudinal shell and the angle of each end section was 0°, i.e., the end sections were parallel with the longitudinal shell. For the intercooler of the FIG. 7 type the parameters were the same as those for the FIG. 2 type except that the angle of the inlet end section was −30° and the angle of the outlet end section was −40°. The pressurized fluid employed was compressed air and the cooling medium was water which flowed through a tube bundle similar to that of the Garrison patent for each of the intercoolers tested. The compressed air flow rate was 2.5 million cubic feet per hour. The temperature and pressure readings were taken in the inlet and outlet ports. The results are shown in Table I.

TABLE I

| | A | B | C |
|---|---|---|---|
| Pressure Drop (psi) | 0.34 | 0.354 | 0.59 |
| Approach Temperature (°F.) | 3.2 | 2.4 | 5.0 |

As can be seen from the data reported in Table I, the intercooler of this invention exhibits markedly improved performance over that obtainable by the commercially available intercooler. The significant reductions in pressure loss and approach temperature represent substantial operating cost savings over the life of the unit.

Although the heat exchanger of this invention having the three-section baffle has been described in detail with reference to certain embodiments, it can be appreciated by those skilled in the art that these are other embodiments which are within the scope of the claimed invention.

What is claimed is:

1. An apparatus for heat transfer with a stream at elevated pressure comprising:

(a) a longitudinal shell;

(b) end plates on each end of said longitudinal shell to form an enclosure;

(c) inlet and outlet ports spaced axially along said longitudinal shell;

(d) a baffle plate within said enclosure oriented diagonally with respect to said longitudinal shell between said inlet and outlet ports;

(e) a tube bundle within said enclosure adapted for flow of heat exchange fluid through the tubes and a cover sheet between the tube bundle and the diagonally oriented baffle plate; and (f) baffle plate and sections connected respectively to each end of said baffle plate, extending respectively from the vicinity of said inlet and outlet ports to said end plates, and oriented at an angle in the range of equal to or greater than 0 degrees with respect to said longitudinal shell and opposite in sign from the angle of the diagonal baffle thereby bending backwards with respect to the orientation of the diagonal baffle.

2. The apparatus of claim 1 wherein the longitudinal shell is cylindrical.

3. The apparatus of claim 1 wherein the diagonal baffle plate is oriented at an angle of from 5° to 45°.

4. The apparatus of claim 1 wherein the diagonal baffle plate is oriented at an angle of from 10° to 30°.

5. The apparatus of claim 1 wherein at least one end section is oriented at an angle of from 0° to 90° with respect to the longitudinal shell and opposite in sign from the angle of the diagonal baffle plate.

6. The apparatus of claim 1 wherein at least one end section is oriented at an angle of from 25° to 90° with respect to the longitudinal shell and opposite in sign from the angle of the diagonal baffle plate.

7. The apparatus of claim 1 wherein the angle of at least one end section changes along its axial length.

8. The apparatus of claim 1 wherein at least one end section is curved.

9. The apparatus of claim 1 wherein the axial length of each end section is from 10 to 45 percent of the axial length of the longitudinal shell.

10. The apparatus of claim 1 wherein the axial length of each end section is from 20 to 30 percent of the axial length of the longitudinal shell.

11. The apparatus of claim 1 further comprising at least one deflecting vane connected to either the diagonally oriented baffle or to a baffle plate end section and extending to an end plate at an angle arithmetically greater than that of the end section with respect to the longitudinal shell.

12. The apparatus of claim 1 further comprising at least one distribution vane connected to the baffle plate end section near the inlet port and positioned so as to divide the inlet flow area into substantially equal parts.

13. The apparatus of claim 12 further comprising a distribution vane connected to said end section distribution vane and positioned so as to divide the inlet flow area into substantially equal parts.

14. The apparatus of claim 1 further comprising at least one collection vane connected to the baffle plate end section near the outlet port and positioned so as to divide the outlet flow area into substantially equal parts.

15. The apparatus of claim 14 further comprising a collection vane connected to said end section collection vane and positioned so as to divide the outlet flow area into substantially equal parts.

16. The apparatus of claim 1 wherein the diagonally oriented baffle plate extends though the entire radial distance from the cover sheet to the longitudinal shell.

17. The apparatus of claim 16 wherein the baffle plate is welded to either or both of the cover sheet and the longitudinal shell.

18. The apparatus of claim 16 wherein sealing material is positioned between the baffle plate and either or both of the cover sheet and the longitudinal shell.

* * * * *

UNITED STATES PATENT AND TRADEMARK OFFICE

CERTIFICATE OF CORRECTION

PATENT NO. : 4,561,498

DATED : December 31, 1985

INVENTOR(S) : J.J. Nowobilski et al

It is certified that error appears in the above-identified patent and that said Letters Patent is hereby corrected as shown below:

In claim 1, line 15, delete "and" and substitute therefor --end--

Signed and Sealed this

*Eleventh* Day of *March 1986*

[SEAL]

*Attest:*

DONALD J. QUIGG

*Attesting Officer*

*Commissioner of Patents and Trademarks*